US012503295B2

(12) United States Patent
Bodet et al.

(10) Patent No.: US 12,503,295 B2
(45) Date of Patent: Dec. 23, 2025

(54) ACTUATOR FOR AEROSOL DISPENSER

(71) Applicant: LINDAL FRANCE SAS, Val de Briey (FR)

(72) Inventors: Hervé Bodet, Verdun (FR); Eric Gaillard, Dieue-sur-Meuse (FR)

(73) Assignee: LINDAL FRANCE SAS, Val de Briey (FR)

( * ) Notice: Subject to any disclaimer, the term of this patent is extended or adjusted under 35 U.S.C. 154(b) by 352 days.

(21) Appl. No.: 18/252,105

(22) PCT Filed: Nov. 9, 2021

(86) PCT No.: PCT/EP2021/081086
§ 371 (c)(1),
(2) Date: May 8, 2023

(87) PCT Pub. No.: WO2022/101186
PCT Pub. Date: May 19, 2022

(65) Prior Publication Data

US 2023/0406604 A1 Dec. 21, 2023

(30) Foreign Application Priority Data

Nov. 10, 2020 (FR) ..... 2011529

(51) Int. Cl.
*B65D 83/20* (2025.01)
*B65D 83/22* (2025.01)
*B65D 83/40* (2006.01)

(52) U.S. Cl.
CPC ..... *B65D 83/20* (2013.01); *B65D 83/22* (2013.01); *B65D 83/40* (2013.01)

(58) Field of Classification Search
CPC ..... B65D 83/20; B65D 83/22; B65D 83/40
See application file for complete search history.

(56) References Cited

U.S. PATENT DOCUMENTS 3,884,393 A * 5/1975 Wassilieff ..... B65D 83/228 222/153.07
4,353,483 A * 10/1982 Pehr ..... B65D 83/145 220/915
4,469,253 A * 9/1984 Beard ..... B65D 83/40 222/153.07
4,482,082 A * 11/1984 Goncalves ..... B65D 83/226 222/182

(Continued)

FOREIGN PATENT DOCUMENTS

AR 099117 A1 6/2016
JP H09-104485 A 4/1997

(Continued)

OTHER PUBLICATIONS

Argentina Office Action and Search Report dated Sep. 23, 2024 in corresponding application No. AR 20210103088; w/ English machine translation (total 12 pages).

(Continued)

*Primary Examiner* — Frederick C Nicolas
(74) *Attorney, Agent, or Firm* — Seckel IP, PLLC

(57) ABSTRACT

The actuator (1) for aerosol dispenser has a first retaining device for fixing the actuator to the can (9) of an aerosol dispenser. The actuator (1) is provided with a separation (23, 24) to render the first retaining device inoperative.

25 Claims, 5 Drawing Sheets

(56) References Cited

U.S. PATENT DOCUMENTS

| | | | | |
|---|---|---|---|---|
| 5,762,322 | A * | 6/1998 | Smith | B65D 83/20 222/402.11 |
| 6,817,488 | B2 * | 11/2004 | Meshberg | B05B 11/0013 222/402.11 |
| 8,939,323 | B2 * | 1/2015 | Knight | B05B 11/1015 222/402.1 |
| 2016/0325916 | A1 | 11/2016 | Jasper et al. | |
| 2017/0362013 | A1 | 12/2017 | Haage | |

FOREIGN PATENT DOCUMENTS

| | | | |
|---|---|---|---|
| JP | H09-301463 | A | 11/1997 |
| JP | H10-17044 | A | 1/1998 |
| JP | 2000-203668 | A | 7/2000 |

OTHER PUBLICATIONS

International Search Report and Written Opinion dated Jan. 25, 2022 in corresponding application No. PCT/EP2021/081086; w/ English partial translation and partial machine translation (total 14 pages).

* cited by examiner

ACTUATOR FOR AEROSOL DISPENSER

FIELD OF THE INVENTION

The invention relates to an actuator for aerosol dispenser, which actuator comprises first retaining means for fixing it to the can of an aerosol dispenser.

SUMMARY OF THE INVENTION

The objective of the invention is to facilitate the recycling of aerosol dispensers when they are empty.

This objective is achieved by the fact that the actuator is provided with separation means to render the first retaining means inoperative.

In a first embodiment, the actuator can comprise a fixing crown provided with the first retaining means and an actuator body, the separation means being placed on the fixing crown and being in the form of one or more lines of weakness which can be torn. The fixing crown preferably has substantially cylindrical symmetry about a main axis and has a lower edge opposite the actuator body. In other words, the fixing crown preferably has a substantially cylindrical shape with a lower edge and an upper edge, the lower edge being farther than the upper edge from the actuator body, and in particular from a push button provided on this actuator body.

The fixing crown can be provided with a single line of weakness which can extend over the entire height of the fixing crown, connecting the two ends of a strip so as to form together the fixing crown before the line of weakness is torn. The fixing crown and the actuator body can be two separate parts and the fixing crown preferably comprises second retaining means to retain the actuator body before the line of weakness is torn. The actuator body can be fixed relative to the fixing crown, or mobile in particular between an unlocked position (ON position) and a locked position (OFF position). It would also be possible for the actuator body to be in one piece with the fixing crown.

The line of weakness can also extend horizontally, in particular in a plane substantially perpendicular to the main axis, over at least a portion of the circumference of the fixing crown, forming a tearable section, the first retaining means being placed between the lower edge of the fixing crown and the plane in which the line of weakness extends. In this case, preferably, a portion of the first retaining means is placed on the face of the tearable section facing the can.

The line of weakness can also start at the lower edge of the fixing crown, extend in the direction of the upper edge opposite the lower edge, beyond the first retaining means, and then extend horizontally over at least a portion of the circumference of the fixing crown, forming a tearable section. Here also, preferably, a portion of the first retaining means is placed on the tearable section.

Another solution consists in providing the separation means in the form of a tearable tab delimited by two lines of weakness which start at the lower edge of the fixing crown and extend vertically in the direction of the upper edge opposite the lower edge, beyond the first retaining means.

To facilitate tearing of the line or lines of weakness, a gripping tab can be provided close to the line or lines of weakness to facilitate tearing of the line or lines of weakness. The gripping tab can be in the form of a cap intended to cover the actuator body during the life of the aerosol dispenser. The gripping tab can be located at the level of the lower edge of the fixing crown or between the lower edge of the fixing crown and the first retaining means.

The actuator body can be provided with a push button and be rotatable relative to the fixing crown between a first position of use and a second position of use. The first position of use is for example an ON position in which it is possible to actuate the valve of the aerosol dispenser, for example by pressing the push button, and the second position of use is an OFF position in which the actuator is prevented from actuating the valve of the aerosol dispenser. One or more, or even an infinity, of intermediate positions of use can be provided between the first and the second position of use. This makes it possible, for example, to pass from a position in which it is possible to fully open the valve (ON position) to a position in which it is not possible to open the valve (OFF position), while passing through intermediate positions in which it is possible to partially open the valve and thus obtain a lower flow than in the ON position, the number of these intermediate positions being limited or infinite.

Rather than tearing at least a portion of the fixing crown, it can also be provided, in a second embodiment, that the actuator comprises an actuator body and a fixing crown, which fixing crown has substantially cylindrical symmetry about a main axis and has a lower edge opposite the actuator body. In other words, the fixing crown preferably has a substantially cylindrical shape with a lower edge and an upper edge, the lower edge being farther than the upper edge from the actuator body, and in particular from a push button provided on this actuator body. The actuator body is rotatably connected to the fixing crown, the actuator body being able to pivot relative to the fixing crown between a first position of use and a second position of use, keeping the first retaining means operative, and being able to pivot into a recycling position, different from the positions of use, in which the actuator body renders the first retaining means inoperative. One or more, or even an infinity, of intermediate positions of use can be provided between the first and the second position of use. The fixing crown is preferably provided with the first retaining means.

In particular, the actuator body can be provided with a push button and be rotatable relative to the fixing crown between an ON position in which it is possible to press the push button to actuate a valve of an aerosol dispenser, and an OFF position in which the actuator is prevented from actuating the valve of the aerosol dispenser, the ON position and the OFF position defining the two positions of use. One or more, or even an infinity, of intermediate positions of use can be provided between the ON position and the OFF position.

The fixing crown may be provided with a cylindrical wall whose lower portion ending in the lower edge is divided into a plurality of angular sections separated from one another by vertical through-slots extending in the direction of the upper edge opposite the lower edge (but without reaching it), snap-ring sections dimensioned to engage under the rolled edge of the can of an aerosol dispenser being placed on the inner face of the angular sections. In addition, the actuator body can comprise a cylindrical wall whose lower portion (portion of the actuator closest to the can when the actuator is mounted on an aerosol dispenser) is designed to be slid over the cylindrical wall of the fixing crown, covering at least partly, preferably entirely, the angular sections. The face of the cylindrical wall directed towards the angular sections can be provided with vertical ribs which are located facing the angular sections when the actuator body is in any position between the first position and the second position of use, or in these positions, and prevent the angular sections from deforming, and which are located facing the slots of the fixing crown and parallel to them when the actuator body is in the recycling position.

Another solution is to provide the fixing crown with horizontal hooks located substantially in a plane perpendicular to the main axis, and to provide the actuator body with deformation elements. The deformation elements are placed in the hooks, deforming them so as to place the free end of the hooks in engagement with the can of an aerosol dispenser when the actuator body is in any position between the first position and the second position of use, or in these positions. In contrast, when the actuator body is in the recycling position, the deformation elements are placed outside the hooks so that the latter are no longer in engagement with the can of the aerosol dispenser.

The separation means are preferably designed so that, after they have been actuated, all the constituents of the actuator, including the tearable tab when there is one, remain attached to one another, forming a one-piece assembly.

BRIEF DESCRIPTION OF THE DRAWINGS

The invention is described in more detail in the following figures which show.

DETAILED DESCRIPTION OF PARTICULAR EMBODIMENTS

Figure 1:
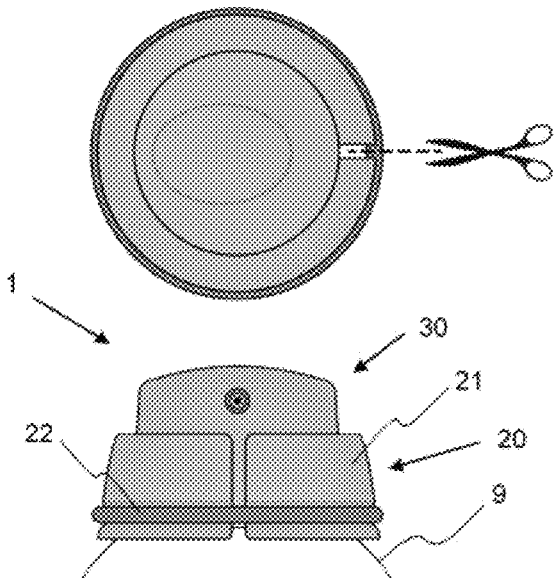
FIG. 1: a first embodiment of the invention in schematic view.

The question arises increasingly of how to recycle packaging at the end of its life. However, an aerosol dispenser consists mainly of a container, constituted by a can (9), usually of metal, and a valve, and of an actuator (1) for actuating the valve, which actuator is made in a very large part of plastic. The can (9) is traditionally in the form of a vessel open at its top by an opening surrounded by a rolled edge (91). The opening is closed by a valve mounted on a cup (92) fitted on the rolled edge (91) by crimping or expanding. When it is a valve of the male type, the valve element, commonly called a stem, has a rod (93) which protrudes from the cup.

The objective of the invention is therefore to make it possible to recycle aerosol dispensers correctly by separating the various materials constituting them, in particular by easily separating the actuator from the container.

To this effect, provision is made to equip the actuator with separation means which, when they are actuated, make it possible to separate the actuator from the container.

Conventionally, the actuator is shown in the figures as it is mounted on a can whose opening is placed at the top, without this being limiting. The references "top"/"bottom", "vertical"/"horizontal" or "upper"/"lower" have only a relative value in relation to the representations of the attached figures. It is self-evident that in certain cases the actuator can be used in other positions and that what is at the top in the position represented here will not necessarily be so when in use. Further, the actuator in the assembled state extends along a main axis (A), which is vertical in the representations of the attached figures. The terms "radial", "axial" and "transverse" refer to this main axis (A).

The actuator is constituted by two main parts: a fixing crown (20, 60) to fix it to the can (9) and an actuator body (30, 70) which can carry in particular a push button. The actuator may also include an outlet conduit for the product, not shown, leading from the valve to a nozzle for diffusing the product into the surrounding space. The outlet conduit can be part of the actuator body or of the fixing crown. First retaining means are provided on the actuator to fix it to the can (9). They are designed to cooperate with first complementary retaining means provided on the can (9). A simple way to make these first retaining means is to provide on the actuator a first circular snap-ring (continuous, or discontinuous in the form of snap-ring sections) designed to engage into the space located under the rolled edge (91) of the can. The first retaining means are generally placed on the fixing crown (20, 60), but they can also be placed on the dispenser body (30, 70).

A function of the separation means is to render these first retaining means inoperative.

Figure 2:
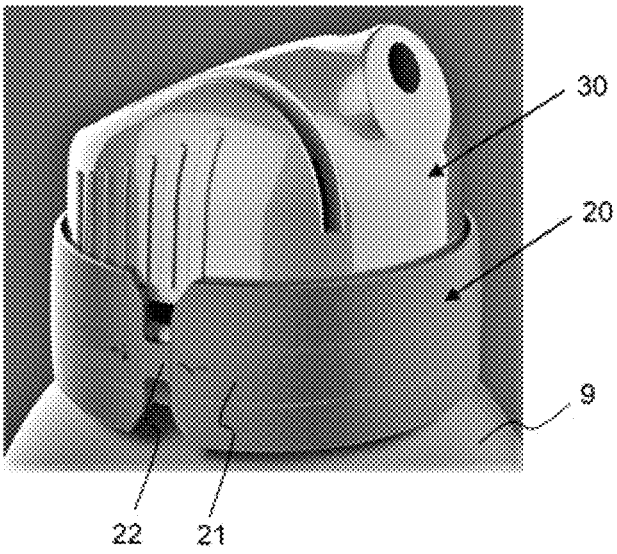
FIG. 2: a first variant of the first embodiment.
Figure 3:
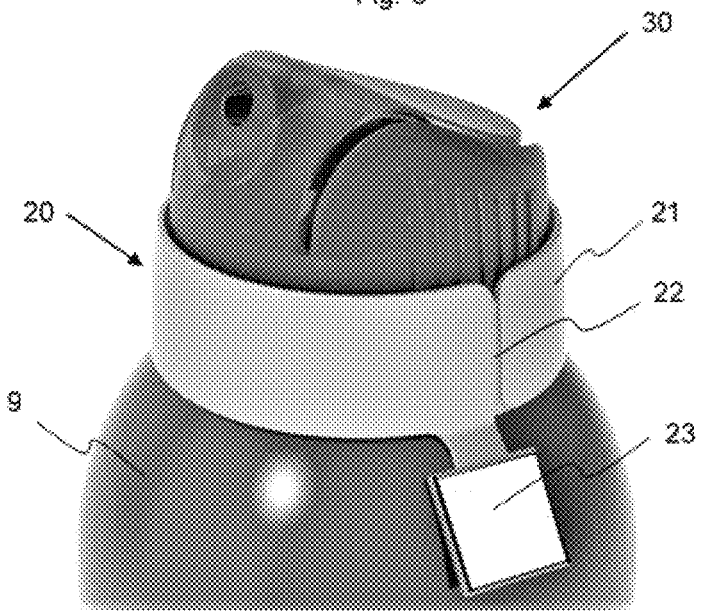
FIG. 3: a second variant of the first embodiment.
Figure 4:
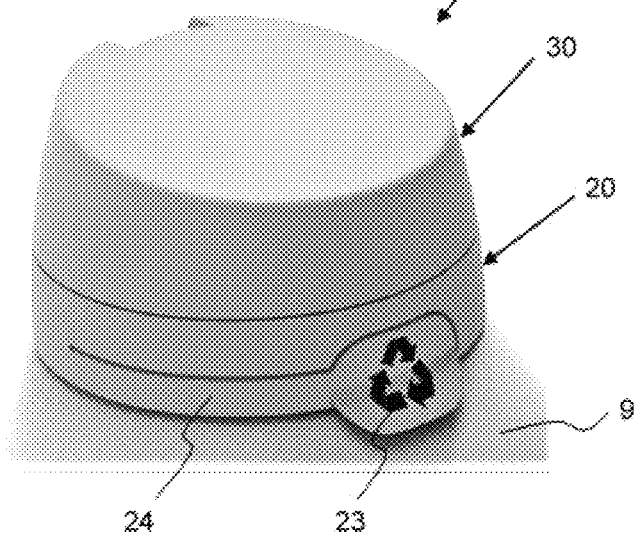
FIG. 4: a second embodiment of the invention.

In a first embodiment shown in FIGS. 1 to 3, the fixing crown (20) and the actuator body (30) are two separate parts. The fixing crown is provided, not only with the first retaining means, but also with second retaining means designed to cooperate with second complementary retaining means provided on the actuator body. The second retaining means or the second complementary retaining means can be made in the form of a second circular snap-ring (continuous or discontinuous) placed on the fixing crown (20) or the actuator body (30) and designed to engage into a groove provided on the other part (30, 20). Without the fixing crown (20), the actuator body (30) is not connected to the can.

The fixing crown (20) is designed as an elongated strip of material (21) whose two ends are connected together by a ring or by a bridge (22). At the end of the life of the aerosol dispenser, the ring or the bridge (22) is broken and the fixing crown opens, making the crown/actuator body and crown/can retaining means ineffective. This ring or this bridge constitutes the separation means.

The bridge (22) can be broken in different ways. The easiest way is to cut it. To this effect, a space may be provided between the bridge and the actuator body and/or the rolled edge (91) of the can to facilitate the passage of a blade. This is the embodiment of FIG. 2.

Another solution shown in FIG. 3 is to design the bridge in the form of a narrow strip of thin material extending over a significant portion of the height of the fixing crown. It can be considered that in the initial state, the strip is closed on itself and has a vertical line of weakness of reduced thickness. To facilitate tearing off the strip, it is preferable to provide a gripping tab (23) on the strip in direct proximity to the bridge (22). The gripping tab (23) can be placed at one of the ends of the line of weakness, preferably at the lower end located on the side of the can (9). At the time of recycling the aerosol dispenser, it is sufficient to pull on the grip tab, which pulls away the corresponding end of the strip from the can and triggers tearing of the bridge.

In a second embodiment of the invention, the fixing crown is closed on itself and continuous, and it is provided with a tearable section (24), which is no longer over the height of the fixing crown to open it in two, but over at least a portion of the circumference of the fixing crown. In the initial position, this tearable section (24) is integral with the fixing crown. It (24) is delimited by a line of weakness of reduced thickness (relative to the thickness of the rest of the fixing crown) which starts at the lower edge of the fixing crown (the edge directed towards the can), extends upwards beyond the first retaining means, and then extends horizontally over an angular portion of the fixing crown. A gripping tab (23) is provided at the end of the tearable section which is located at the level of the lower edge of the fixing crown. A portion of the first retaining means is placed on the tearable section. As long as the tearable section is fixed to the fixing crown, all the first retaining means function normally. When the aerosol dispenser is empty, it is sufficient to pull on the gripping tab, pulling away the first end of the tearable section from the can. The line of weakness which connects it to the rest of the fixing crown is torn and a portion of the retaining means is made ineffective. Since the actuator is only retained on the can by a portion of the first retaining means, it is easy to unhook it from the can in order to recycle it. The tearable section constitutes the separation means. The advantage of this solution over that of the first embodiment is that, if the fixing crown is integral with the actuator body, there are no separate parts which would risk being lost and not recycled, as could be the case with the strip (21).

Figure 5:
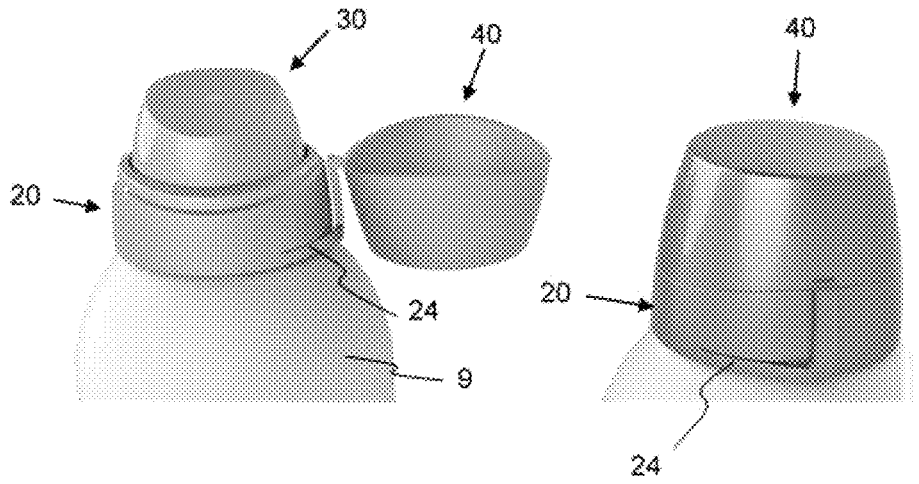
FIG. 5: a first variant of the second embodiment of the invention.

In a first variant of this second embodiment shown in FIG. 5, the gripping tab for tearing the tearable section is constituted by a cap (40) which in normal times is intended to be folded down onto the actuator. The cap (40) could also serve as a gripping tab for the second variant of the first embodiment, or more generally, in all embodiments using a gripping tab. In the embodiment of FIG. 5, the line of weakness can start at a distance from the lower edge of the fixing crown, a slot leading from the lower edge of the fixing crown to the start of the line of weakness.

Figure 6:
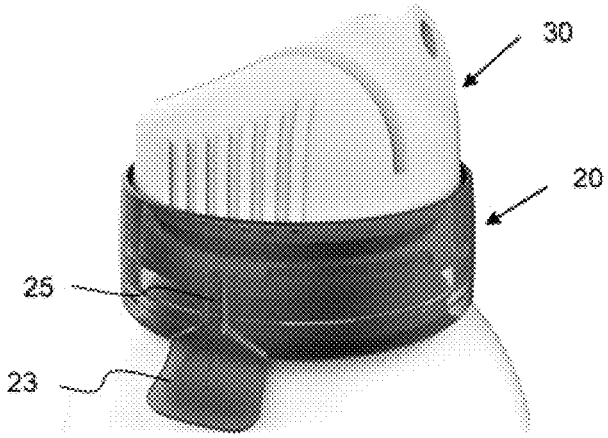
FIG. 6: a second variant of the second embodiment of the invention.
Figure 7:
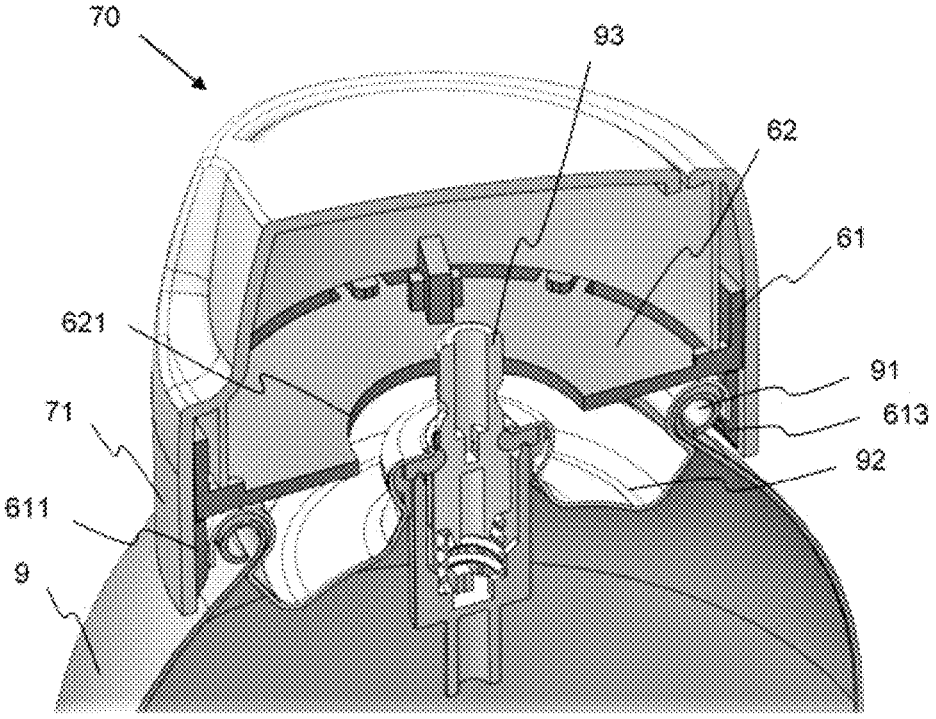
FIG. 7: a third embodiment of the invention in the example of an ON/OFF actuator.
Figure 8:
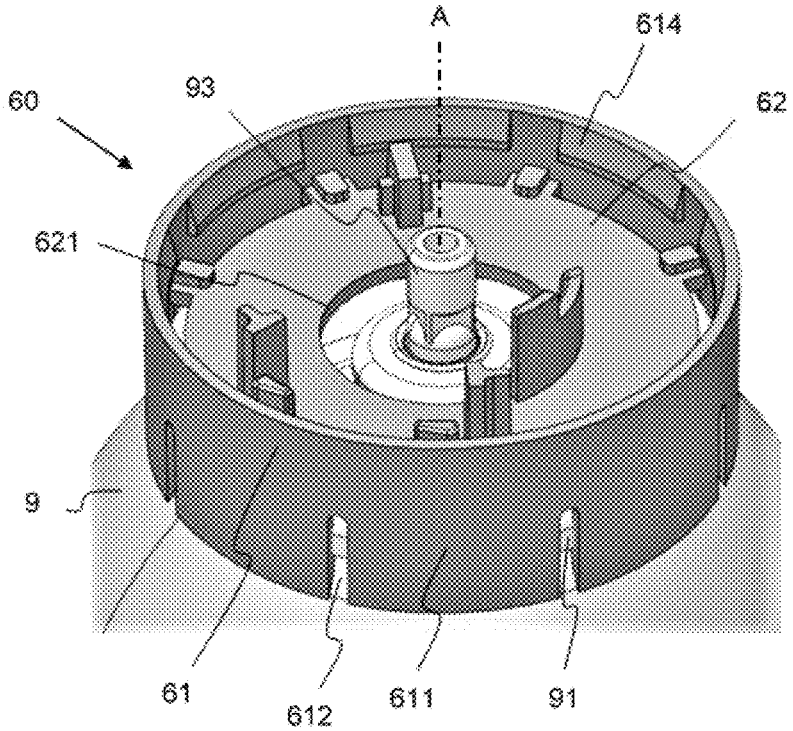
FIG. 8: a fixing crown of the third embodiment.

In a second variant of the second embodiment shown in FIG. 6, the separation means are constituted by a tearable section (25) which here also is oriented vertically. The tearable section is defined by two lines of weakness each starting from the lower edge of the fixing crown and extending vertically up to above the first retaining means. A gripping tab (23) is formed at the first end of the tearable section (25) located at the level of the lower edge of the fixing crown. At the end of the life of the aerosol dispenser, the gripping tab is pulled, the lines of weakness are torn, and the tearable section (25) moves away from the can, leaving a slot in its place. The thus partly split fixing crown is easily deformed, allowing the actuator to be unhooked from the can.

The first two embodiments are particularly well suited to simple actuators. They can also be used for actuators of the ON-OFF type in which a push button is rotatable relative to a base between an ON position, in which it is possible to press the push button to actuate the valve, and an OFF position in which it is not possible to actuate the valve. The push button can be constituted by the actuator body and the base by the fixing crown (see for example FIG. 6.). It can also be provided that the actuator body comprises the base and the fixing crown, and that the fixing crown is used to connect this assembly to the can.

In a third embodiment of the invention, which is particularly well suited to actuators of the ON/OFF type, the fixing crown (60) is constituted by a cylindrical wall (61) whose lower portion is divided into a plurality of angular sections (611) separated from one another by vertical through-slots (612). A radial wall (62) is placed inside the cylindrical wall (61). It is provided with an opening (621) for the passage of the rod (93) of the stem when the actuator is mounted on a male valve, or the passage of the product outlet rod located on the actuator and intended to actuate a female valve. The radial wall (62) can carry some of the components necessary for the ON/OFF function.

The first retaining means are placed on the angular sections (611) and take the form of snap-ring sections (613) dimensioned to engage under the rolled edge (91) of the can. As it is, the fixing crown can be fixed on the can where it is retained, but it can also be easily removed therefrom by elastic deformation of the angular sections (611) towards the outside. In the mounted state, the radial wall (62) bears against the cup of the valve and the retaining means engage with the rolled edge (91) of the can.

The fixing crown (60) also comprises second retaining means (614) to retain the actuator body (70) so that it can rotate about the main axis (A) passing through the center of the valve and the can. The actuator body (70) is provided with second complementary retaining means so that, once the second retaining means of the fixing crown have engaged with the second complementary retaining means of the actuator body, the latter can no longer be detached from the fixing crown without damaging the actuator.

The actuator body (70) comprises in particular a cylindrical wall (71) whose lower portion is designed to be slid over the cylindrical wall (61) of the fixing crown, covering at least in part, but preferably entirely, the angular sections (611). In the assembled state, the lower portion of the cylindrical wall (71) of the actuator body, not only covers at least partially the angular sections (611), but it prevents them from deforming outwardly out of engagement with the rolled edge (91) of the can.

In normal times, the actuator body can pivot relative to the fixing crown between the ON position, in which the valve of the aerosol dispenser can be actuated, and the OFF position in which the valve of the aerosol dispenser cannot be actuated, the lower portion of the cylindrical wall (71) preventing deformation of the angular sections (611) and unhooking of the fixing crown. However, a third position is provided, called recycling position, in which the lower portion of the cylindrical wall no longer prevents the angular sections (611) from deforming. It is then possible to unhook the assembly constituted by the fixing crown and the actuator body.

Figure 9A:
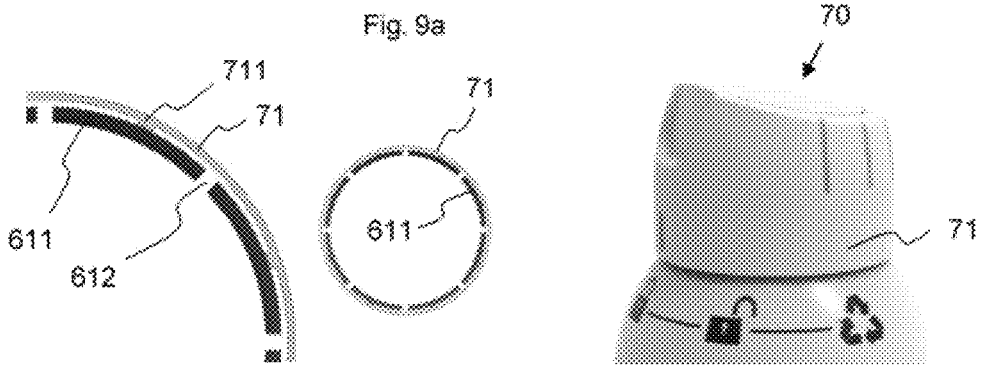
FIG. 9: the different positions of the actuator body of the third embodiment (a) in the locked position (OFF) and (b) in the recyclable position.

To this effect, the lower portion of the cylindrical wall (71) of the actuator body is provided, on its face directed towards the angular sections, with vertical ribs (711) which are located facing the angular sections when the actuator body is in any position between the ON position and the OFF position (cf. FIG. 9*a*). This way, they prevent the angular sections from deforming. The vertical ribs can be in contact with the angular sections, or simply close to them and only in contact with them in the event of the onset of deformation. In the normal position of use, the contact between the ribs and the angular sections, if it exists, does not cause significant friction in order to allow the actuator body to rotate easily relative to the fixing crown.

Figure 9B:
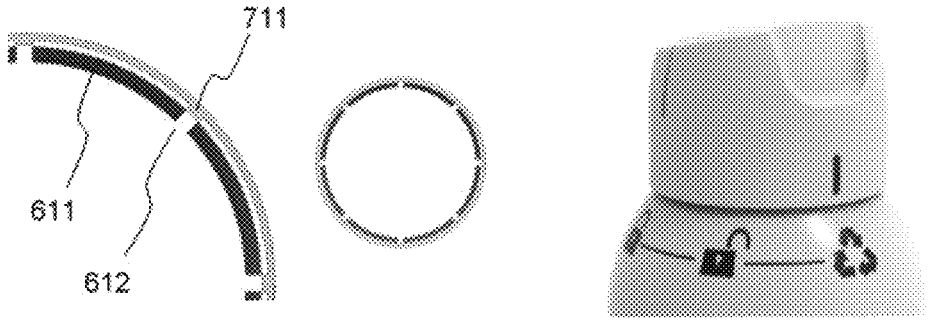
Figure 10:
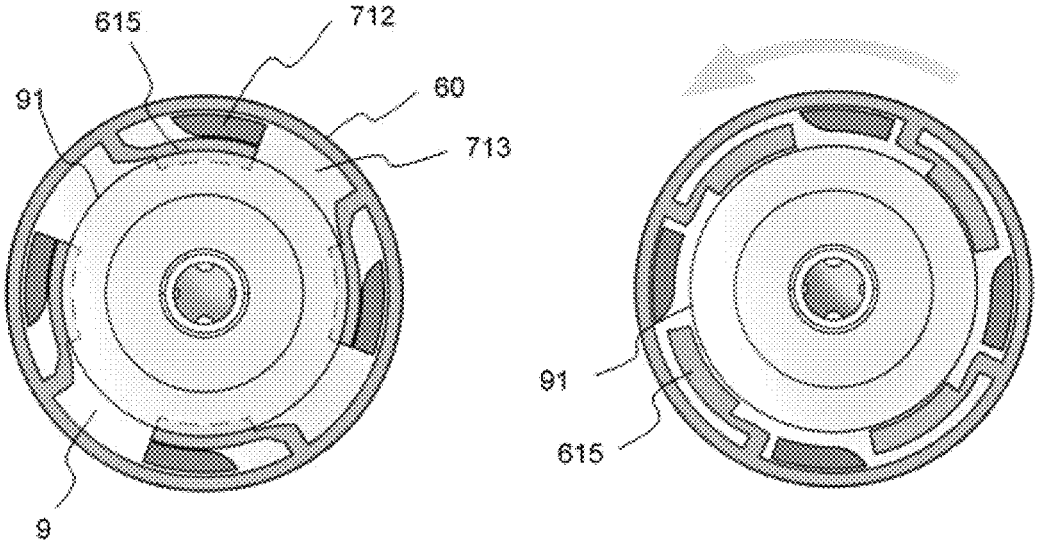
FIG. 10: a second variant of the third embodiment (a) in the unlocked position (ON) and (b) in the recyclable position.

When the aerosol dispenser is empty, the actuator body is rotated into the recycling position. In this position visible in FIG. 9*b*, the vertical ribs are aligned with the slots (612) separating the angular sections (611). The latter can deform freely if the actuator is pulled upwards. It is therefore possible to unhook the actuator from the can. An obstacle can be provided between the recycling position and the adjacent ON or OFF position of use (ON in the example of FIGS. 9*a* and 9*b*), which obstacle must be overcome when the actuator body leaves this position of use to reach the recycling position, so that it takes a certain force in order to pass the obstacle to bring the actuator body (70) into the recycling position, and thus prevents this position from being reached inadvertently.

For better effectiveness, preferably, there are as many vertical ribs (711) as there are angular sections (611) and the height of the vertical ribs is substantially the same as that of the slots (612), or only slightly shorter.

In a fourth embodiment which is also particularly well suited to actuators of the ON/OFF type, the actuator is fixed to the can by horizontal hooks (615) which are deformed by deformation elements (712) which place them under the rolled edge (91) of the can where they engage with it.

The actuator body (70) is provided in its lower portion with a plurality of deformation elements (712) in the shape of an arc of a circle, separated from one another by spaces (713). The actuator body can be placed on the valve without its deformation elements (712) engaging under the rolled edge (91) of the can. The length of the deformation elements is such that when the actuator is mounted on the can, the deformation elements protrude under the rolled edge (91) of the can, leaving a space between them and the neck of the can located under the rolled edge (91).

The inner face of the fixing crown (60) is provided with a plurality of horizontal hooks (615), which are images of one another by rotational symmetry. These hooks are designed to come in position under the rolled edge (91), between the can and the deformation elements (712). The length of the hooks (615) is less than the distance separating two deformation elements (712). In other words, the length of the hooks is less than the angular width of the spaces (713). In the undeformed position, each hook can take place in one of these spaces (713). The side edges of the deformation elements (712), at least on the side from which the openings of the hooks (712) approach, are preferably chamfered to move the free parts of the hooks located on the side of the openings towards the can. When the actuator body (70) is rotated relative to the fixing crown (60) so that the openings of the hooks come to engage with the deformation elements (712) of the actuator body, the chamfered portions of the deformation elements push the free ends of the hooks (615) towards the can, the free ends of the hooks (615) passing under the rolled edge (91) of the can and coming into engagement with it. By continuing to rotate in the same direction, the deformation elements (712) continue to advance in the hooks (615) and can reach, with their chamfered portion, the bottom of the hooks. Whatever the position of the deformation elements in the hooks, at least a portion of the free ends of the hooks engages with the rolled edge so that the actuator is fixed to the can. When the actuator body is rotated between the ON and OFF positions, the deformation elements (712) remain within the hooks and keep them in engagement with the rolled edge of the can.

When the aerosol dispenser is empty, the actuator body must be rotated beyond one of the normal limit positions (ON or OFF) to make the deformation elements (712) come out of the hooks (615). The hooks are then located in the spaces (713), nothing is left to force the hooks under the rolled edge of the can, and it is possible to unhook the actuator from the can. Here also, an obstacle can be provided between the recycling position and the adjacent ON or OFF position of use, which obstacle must be overcome when the actuator body leaves this position of use to reach the recycling position.

In a variant embodiment, it is the fixing crown that carries the deformation elements and the actuator body that carries the horizontal hooks.

The various embodiments are particularly well suited to actuators of the ON/OFF type. More generally, they can be applied to actuators having two or more positions of use, or even an infinity of positions of use between two extreme positions. For example, the actuator can be a three-position actuator with which it is possible to supply, in a first position, a product A alone, in a second position, a product B alone, and in a third position, a mixture of products A and B. In some cases, there can be one or more intermediate positions, or even an infinity, in which the product A/product B ratio varies (for example 25/75, 50/50, 75/25). Further, the actuator can be an actuator having a first position with minimum flow (or even zero=OFF position) and a second position with maximum flow, and a plurality of intermediate positions, or even an infinity of intermediate positions, between these two extreme positions, with different flow rates between the minimum or zero flow and the maximum flow.

The various embodiments can be used both for valves of the male type, whose stem is provided with a protruding rod and cooperates with a corresponding endpiece of the actuator, in particular of the actuator body, and for valves of the female type, whose seat can be moved back by a rod fixed to the actuator, and in particular to the actuator body.

LIST OF REFERENCES

1 Actuator
- 20 Fixing crown
  - 21 strip
  - 22 bridge connecting the two ends of the strip
  - 23 tab
  - 24 tearable section
  - 25 tearable section
- 30 Actuator body
- 40 Cap
- 60 Fixing crown
  - 61 cylindrical wall
    - 611 angular sections
    - 612 vertical slots or recesses
    - 613 first retaining means
    - 614 second retaining means
    - 615 hooks
  - 62 radial wall
    - 621 Opening
- 70 Actuator body
  - 71 cylindrical wall
    - 711 vertical ribs
    - 712 deformation elements
    - 713 spaces between the deformation elements
- 9 Can
  - 91 rolled edge of the opening of the can
  - 92 valve cup
  - 93 rod of the stem
- A Main axis

The invention claimed is:

1. An actuator for aerosol dispenser, the actuator comprising:

an actuator body, first retaining means adapted to fix the actuator body to a can of an aerosol dispenser, separation means adapted to render the first retaining means inoperative, and a fixing crown having cylindrical symmetry about a main axis and having a lower edge opposite the actuator body, the actuator body being rotatably connected to the fixing crown, the actuator body being able to pivot about the main axis relative to the fixing crown between a first position of use and a second position of use, keeping the first retaining means operative, and being able to pivot into a recycling position, different from the first and second positions of use, in which the actuator body renders the first retaining means inoperative.

2. The actuator according to claim 1, wherein the fixing crown is provided with the first retaining means.

3. The actuator according to claim 1, wherein the actuator body is provided with a push button, and the actuator body is rotatable relative to the fixing crown between an ON position in which the push button is capable of being pressed to actuate a valve of the aerosol dispenser, and an OFF position in which the actuator is prevented from actuating the valve of the aerosol dispenser, the ON position and the OFF position defining the first and second positions of use.

4. The actuator according to claim 1, wherein the fixing crown is provided with a cylindrical wall whose lower portion ending in the lower edge is divided into a plurality of angular sections separated from one another by through-slots extending in a direction of an upper edge opposite the lower edge, snap-ring sections dimensioned to engage under a rolled edge of the can of the aerosol dispenser being placed on inner faces of the angular sections, and the actuator body comprises a cylindrical wall whose lower portion is designed to be slid over the cylindrical wall of the fixing crown, covering at least partly the angular sections, a face of the cylindrical wall directed towards the angular sections being provided with ribs, the ribs being located facing the angular sections when the actuator body is in any position between the first position and the second position of use, when the actuator body is in the first position of use, and when the actuator body is in the second position of use, and the ribs being located facing the slots of the fixing crown and parallel to the slots of the fixing crown when the actuator body is in the recycling position.

5. The actuator according to claim 1, wherein the fixing crown is provided with hooks located in a plane perpendicular to the main axis, and wherein the actuator body comprises deformation elements, the deformation elements being placed in the hooks and deforming the hooks so as to place a free end of the hooks in engagement with the can of the aerosol dispenser when the actuator body is in any position between the first position and the second position of use, when the actuator body is in the first position of use, and when the actuator body is in the second position of use, and the deformation elements being placed outside of the hooks so that the hooks are no longer in engagement with the can of the aerosol dispenser when the actuator body is in the recycling position.

6. The actuator according to claim 1, wherein the separation means are designed so that, after the separation means have been actuated, all constituents of the actuator remain attached to one another, forming a one-piece assembly.

7. The actuator according to claim 1, wherein one or more intermediate positions of use are provided between the first and the second position of use.

8. An actuator for aerosol dispenser, the actuator comprising:

an actuator body, first retaining means adapted to fix the actuator body to a can of an aerosol dispenser, separation means adapted to render the first retaining means inoperative, and a fixing crown provided with the first retaining means, wherein the fixing crown has cylindrical symmetry about a main axis and has a lower edge opposite the actuator body, the separation means is placed on the fixing crown and forms a single line of weakness which can be torn, and the single line of weakness starts at the lower edge of the fixing crown, extends in a direction of an opposite edge, beyond the first retaining means, and then extends horizontally over at least a portion of the circumference of the fixing crown, forming a tearable section.

9. The actuator according to claim 8, wherein the fixing crown and the actuator body are two separate parts, and the fixing crown comprises second retaining means to retain the actuator body before the line of weakness is torn.

10. The actuator according to claim 8, wherein a portion of the first retaining means is placed on the tearable section.

11. The actuator according to claim 8, wherein a gripping tab is provided close to the line of weakness to facilitate tearing of the line of weakness.

12. The actuator according to claim 11, wherein the gripping tab forms a cap adapted to cover the actuator body during a life of the aerosol dispenser, and/or the gripping tab is located at a level of the lower edge of the fixing crown or the gripping tab is located between the lower edge of the fixing crown and the first retaining means.

13. The actuator according to claim 8, wherein the actuator body is provided with a push button, the actuator body being rotatable about the main axis relative to the fixing crown between a first position of use and a second position of use.

14. The actuator according to claim 13, wherein one or more intermediate positions of use are provided between the first and the second position of use, the first position of use being an ON position in which the push button can be pressed to actuate a valve of the aerosol dispenser, and the second position of use being an OFF position in which the actuator is prevented from actuating the valve of the aerosol dispenser.

15. The actuator according to claim 8, wherein the separation means are designed so that, after the separation means have been actuated, all constituents of the actuator remain attached to one another, forming a one-piece assembly.

16. The actuator according to claim 8, wherein a portion of the first retaining means is placed on the tearable section.

17. An actuator for aerosol dispenser, the actuator comprising:

an actuator body, first retaining means adapted to fix the actuator body to a can of an aerosol dispenser, separation means adapted to render the first retaining means inoperative, and a fixing crown provided with the first retaining means, wherein the fixing crown has cylindrical symmetry about a main axis and has a lower edge opposite the actuator body, the separation means is placed on the fixing crown and forms one or more lines of weakness which can be torn, and a gripping tab is provided close to the one or more lines of weakness to facilitate tearing of the one or more lines of weakness, and wherein the gripping tab forms a cap adapted to cover the actuator body during a life of the aerosol dispenser, and/or the gripping tab is located at a level of the lower edge of the fixing crown or the gripping tab is located between the lower edge of the fixing crown and the first retaining means.

18. The actuator according to claim 17, wherein the fixing crown is provided with a single line of weakness which extends over an entire height of the fixing crown, connecting two ends of a strip so as to form together the fixing crown before the line of weakness is torn.

19. The actuator according to claim 18, wherein the fixing crown and the actuator body are two separate parts, and the fixing crown comprises second retaining means to retain the actuator body before the line of weakness is torn.

20. The actuator according to claim 17, wherein the fixing crown is provided with a single line of weakness which extends in a plane perpendicular to the main axis over at least a portion of a circumference of the fixing crown, forming a tearable section, the first retaining means being placed between the lower edge of the fixing crown and a plane in which the line of weakness extends.

21. The actuator according to claim 20, wherein a portion of the first retaining means is placed on the tearable section.

22. The actuator according to claim 17, wherein the separation means form a tearable tab delimited by two lines of weakness which start at the lower edge of the fixing crown, extend in a direction of an opposite edge, beyond the first retaining means.

23. The actuator according to claim 17, wherein the actuator body is provided with a push button, the actuator body being rotatable about the main axis relative to the fixing crown between a first position of use and a second position of use.

24. The actuator according to claim 23, wherein one or more intermediate positions of use are provided between the first and the second position of use, the first position of use being an ON position in which the push button can be pressed to actuate a valve of the aerosol dispenser, and the second position of use being an OFF position in which the actuator is prevented from actuating the valve of the aerosol dispenser.

25. The actuator according to claim 17, wherein the separation means are designed so that, after the separation means have been actuated, all constituents of the actuator remain attached to one another, forming a one-piece assembly.

* * * * *